US011239611B2

(12) United States Patent
Lin et al.

(10) Patent No.: US 11,239,611 B2
(45) Date of Patent: Feb. 1, 2022

(54) CABLE ASSEMBLY WITH DIELECTRIC CLAMSHELL CONNECTOR FOR IMPEDANCE CONTROL

(71) Applicant: TE Connectivity Services GmbH, Schaffhausen (CH)

(72) Inventors: Bin Lin, Hummelstown, PA (US); Nathan William Swanger, Dillsburg, PA (US); John Wesley Hall, Hummelstown, PA (US)

(73) Assignee: TE Connectivity Services GmbH

( * ) Notice: Subject to any disclaimer, the term of this patent is extended or adjusted under 35 U.S.C. 154(b) by 0 days.

(21) Appl. No.: 16/849,447

(22) Filed: Apr. 15, 2020

(65) Prior Publication Data

US 2021/0328387 A1 Oct. 21, 2021

(51) Int. Cl.

| | |
|---|---|
| ***H01R 13/00*** | (2006.01) |
| ***H01R 13/6581*** | (2011.01) |
| ***H01R 13/506*** | (2006.01) |
| ***H01R 13/41*** | (2006.01) |

(52) U.S. Cl.
CPC ..... *H01R 13/6581* (2013.01); *H01R 13/41* (2013.01); *H01R 13/506* (2013.01)

(58) Field of Classification Search
CPC ... H01R 13/6581; H01R 13/41; H01R 13/506
USPC ..... 439/607.56
See application file for complete search history.

(56) References Cited

U.S. PATENT DOCUMENTS 5,945,634 A * 8/1999 Shimirak ..... H02G 15/085 174/71 C
6,203,369 B1 * 3/2001 Feldman ..... H01R 24/40 439/579
7,563,118 B1 * 7/2009 McCauley ..... H01R 13/533 439/260
8,235,731 B1 * 8/2012 Poulsen ..... H01R 13/6658 439/76.1

(Continued)

FOREIGN PATENT DOCUMENTS

DE 431880 A1 8/1994

OTHER PUBLICATIONS

International Search Report, International Application No. PCTIB2021/053141 International Filing Date, Apr. 15, 2021.

*Primary Examiner* — Abdullah A Riyami
*Assistant Examiner* — Nelson R. Burgos-Guntin

(57) ABSTRACT

A connector for controlling impedance for use in a connector assembly, the connector has a housing made of dielectric material. The housing has a first conductor receiving opening and a second conductor receiving opening which are dimensioned to receive exposed conductors of a cable. The first conductor receiving opening and the second conductor receiving opening have conductor receiving portions, the conductor receiving portions extending at an angle relative to a longitudinal axis of the housing. The first conductor receiving opening and the second conductor receiving opening have conductor spacing portions which extend from the conductor receiving opening. The conductor spacing portions extend in a direction which is essentially parallel to the longitudinal axis of the housing. The spacing portions are spaced apart by a distance. The dielectric material and the distance the spacing portions are spaced apart being selected to match the impedance of the cable.

20 Claims, 4 Drawing Sheets

(56) References Cited

U.S. PATENT DOCUMENTS

| | | | | |
|---|---|---|---|---|
| 8,371,877 | B2 | 2/2013 | Kooiman | |
| 8,928,338 | B2 * | 1/2015 | Nelson | G01N 15/0656 324/691 |
| 9,354,142 | B2 * | 5/2016 | Tahira | G01N 27/407 |
| 2002/0137397 | A1 * | 9/2002 | Little | H01R 13/7032 439/686 |
| 2003/0073331 | A1 * | 4/2003 | Peloza | H01R 13/6585 439/108 |
| 2005/0239319 | A1 * | 10/2005 | Takasu | H01R 24/44 439/394 |
| 2009/0221175 | A1 * | 9/2009 | Pearson | H01R 4/183 439/423 |
| 2009/0314056 | A1 * | 12/2009 | McCauley | G01N 27/4078 73/23.31 |
| 2009/0318014 | A1 * | 12/2009 | McCauley | H01R 13/533 439/485 |
| 2012/0315801 | A1 * | 12/2012 | Kwasny | H01R 43/20 439/695 |
| 2014/0120769 | A1 * | 5/2014 | Dang | H01R 13/502 439/607.05 |
| 2016/0126686 | A1 * | 5/2016 | Sanders | H01R 25/003 439/620.21 |
| 2016/0134032 | A1 * | 5/2016 | Hall | H01R 13/434 439/578 |
| 2018/0261933 | A1 | 9/2018 | Maesoba et al. | |
| 2018/0288513 | A1 * | 10/2018 | Ball | H04R 1/1075 |
| 2019/0267727 | A1 | 8/2019 | Zebhauser et al. | |

* cited by examiner

CABLE ASSEMBLY WITH DIELECTRIC CLAMSHELL CONNECTOR FOR IMPEDANCE CONTROL

FIELD OF THE INVENTION

The present invention is directed to a cable assembly which controls impedance. In particular, the invention is directed to a cable assembly which utilizes a dielectric clamshell component to control cable termination impedance.

BACKGROUND OF THE INVENTION

Maintaining signal integrity in communications is always desired. Factors that affect signal integrity include cable design and the process that is used to terminate or attach a cable. Cables are typically made of at least one plated, or unplated, center conductor covered by a dielectric and a braid and/or foil shield protector with an overall non-conductive jacket. The termination of the braid onto a device, such as a printed circuit board (PCB) or a connector, can significantly affect cable performance.

Various methods are known to terminate shield, components, including soldering the end of the wire onto a PCB/connector termination, laser terminating parallel gap resistance welding. Another comment method of termination is to use a ferrule. One significant problem with a ferrule is that crimping the wire to apply the ferrule tends to crush the cable dielectric. Another problem with existing methods of terminating a braid is that they can tend to rearrange the placement of the differential pair within the cable jacket. Both problems can affect impedance and other electrical parameters, which affect signal integrity.

It would be, therefore, beneficial to provide a cable assembly which controls impedance and which does not damage or rearrange the conductors. In particular, it would be beneficial to a cable assembly which utilizes a dielectric clamshell component to control cable termination impedance.

SUMMARY OF THE INVENTION

An embodiment is directed to a connector for controlling impedance for use in a connector assembly, the connector has a housing with a first conductor receiving opening and a second conductor receiving opening. The first conductor receiving opening and the second conductor receiving opening are dimensioned to receive exposed conductors of a cable. The first conductor receiving opening and the second conductor receiving opening have conductor receiving portions, the conductor receiving portions extending at an angle relative to a longitudinal axis of the housing. The first conductor receiving opening and the second conductor receiving opening have conductor spacing portions which extend from the conductor receiving opening. The conductor spacing portions extend in a direction which is essentially parallel to the longitudinal axis of the housing. The spacing portions are spaced apart by a distance. The distance the spacing portions are spaced apart being selected to match the impedance of the cable.

An embodiment is directed to a cable assembly for terminating a cable having exposed conductors. The cable assembly includes a clamshell connector for controlling impedance. The clamshell connector has a housing made of dielectric material. The housing has a first conductor receiving opening and a second conductor receiving opening. The first conductor receiving opening and the second conductor receiving opening are dimensioned to receive exposed conductors of a cable. The first conductor receiving opening and the second conductor receiving opening have conductor receiving portions, the conductor receiving portions extending at an angle relative to a longitudinal axis of the housing. The first conductor receiving opening and the second conductor receiving opening have conductor spacing portions which extend from the conductor receiving opening. The conductor spacing portions extend in a direction which is essentially parallel to the longitudinal axis of the housing. The spacing portions are spaced apart by a distance. The dielectric material and the distance the spacing portions are spaced apart being selected to match the impedance of the cable. A shield member extends from the cable. The shield member being positioned over the connector.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
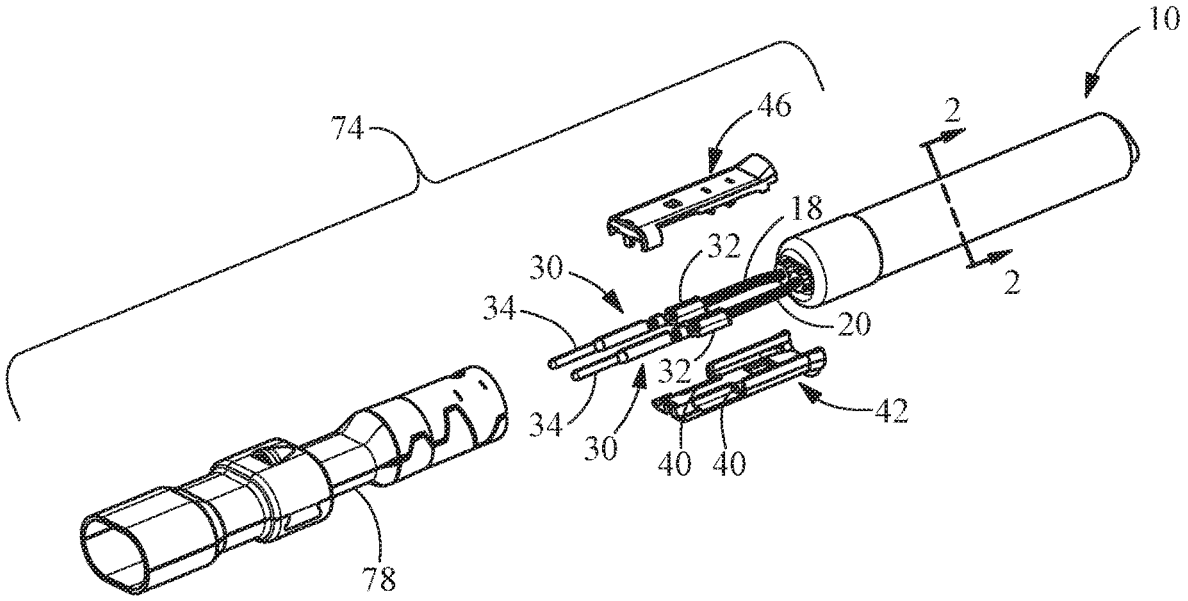
FIG. 1 is an exploded perspective view of a cable assembly according to the present invention.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

Moreover, the features and benefits of the invention are illustrated by reference to the preferred embodiments. Accordingly, the invention expressly should not be limited to such embodiments illustrating some possible non-limiting combination of features that may exist alone or in other combinations of features, the scope of the invention being defined by the claims appended hereto.

Figure 2:
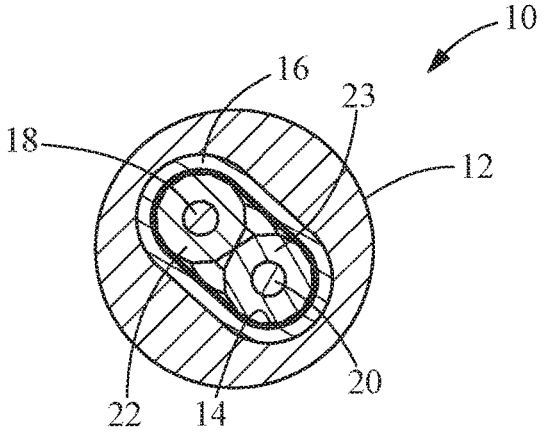
FIG. 2 is a cross sectional view of the cable taken along line 2-2 of FIG. 1.
Figure 6:
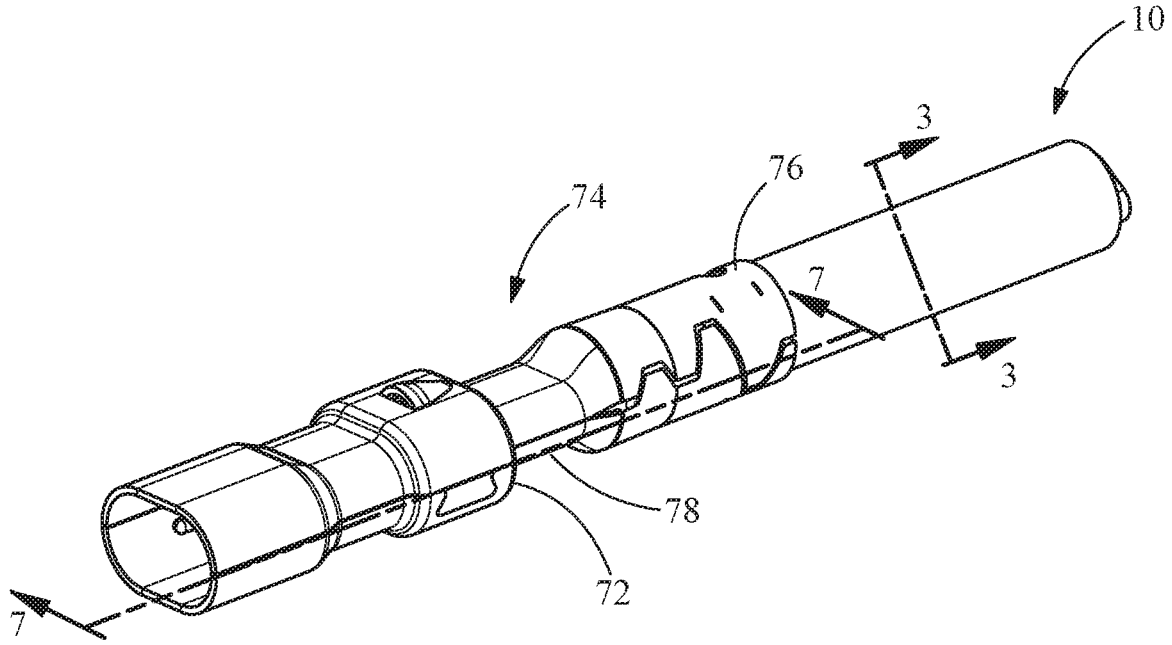
FIG. 6 is a perspective view of the cable assembly fully assembled.

A cable 10 is illustrated in FIGS. 1 and 6. The cable 10 can transfer data between and among storage devices, switches, routers, printed circuit boards (PCBs), analog to digital converters, connectors, and other devices. In various embodiments, the cable 10 can support data transfer rates of 100 Mbps and higher. In some embodiments, the cable 10 can support data transfer rates of approximately 4.25 Gbps to approximately 25 Gbps. The cable 10 also can be used with data transfer rates above or below these exemplary rates. As shown in FIG. 2, the cable 10 has a cable jacket 12, a braided shield 16, a metalized foil 14 and two center conductors 18, 20. The conductors 18, 20 are spaced from each other and extend essentially parallel to each other. The conductors 18, 20 are surrounded by braided metal shield 16, such as, but not limited to braided copper shielding. The center conductors 18, 20 may also be surrounded by individual dielectrics 22, 23.

Figure 7:
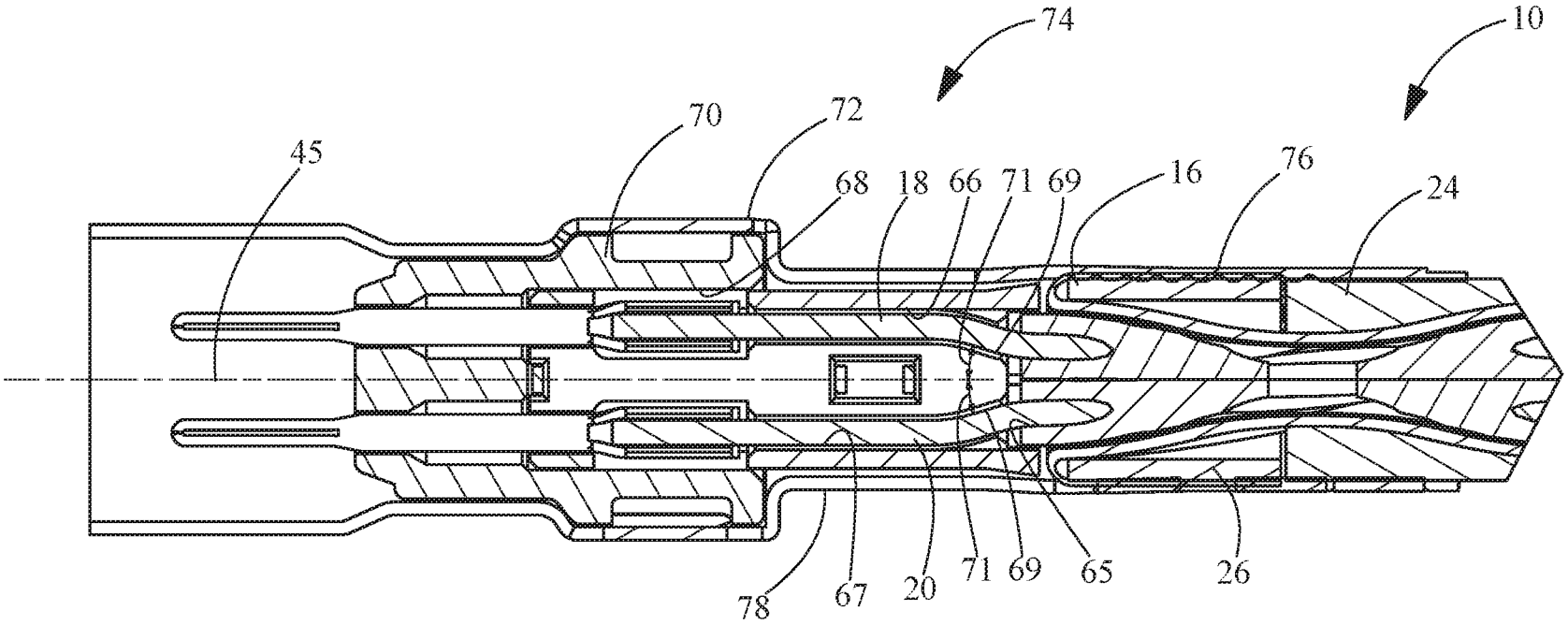
FIG. 7 is a cross sectional view of the cable assembly of FIG. 6, taken along line 7-7.

As shown in FIGS. 1 and 7, an end of the cable 10 has the cable jacket 12 removed. A portion 24 of the cable 10 may include a ferrule 26 provided proximate the end thereof. In such applications, the braided shield 16 would be folded back over the ferrule 26. The dielectrics of the conductors 18, 20 are also removed, thereby exposing a portion of the conductors 18, 20.

Figure 4:
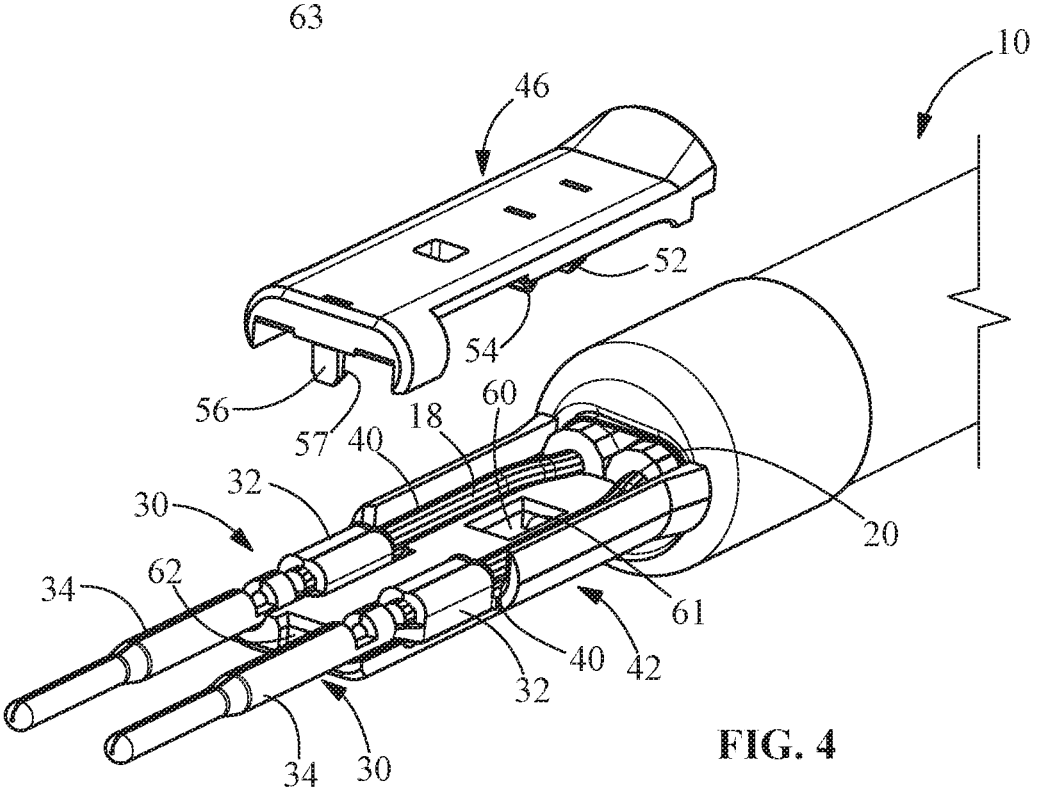
FIG. 4 is an enlarged perspective view of conductors position in a first portion of the clamshell connector, with a second portion of the clamshell connector exploded therefrom.

With the conductors 18, 20 exposed, terminals 30 are positioned on the ends of the conductors 18, 20. As shown in FIG. 4, wire terminating portions 32 of the terminals 30 are crimped to the conductors 18, 20. However, other methods of terminating the terminals 30 to the conductors 18, 20 may be used. In the illustrative embodiment shown, the terminals 30 are male terminals with pin portions 34 extending from the wire terminating portions 32. However, other configurations of terminals, including, but not limited to, female socket terminals, may be used.

Figure 3:
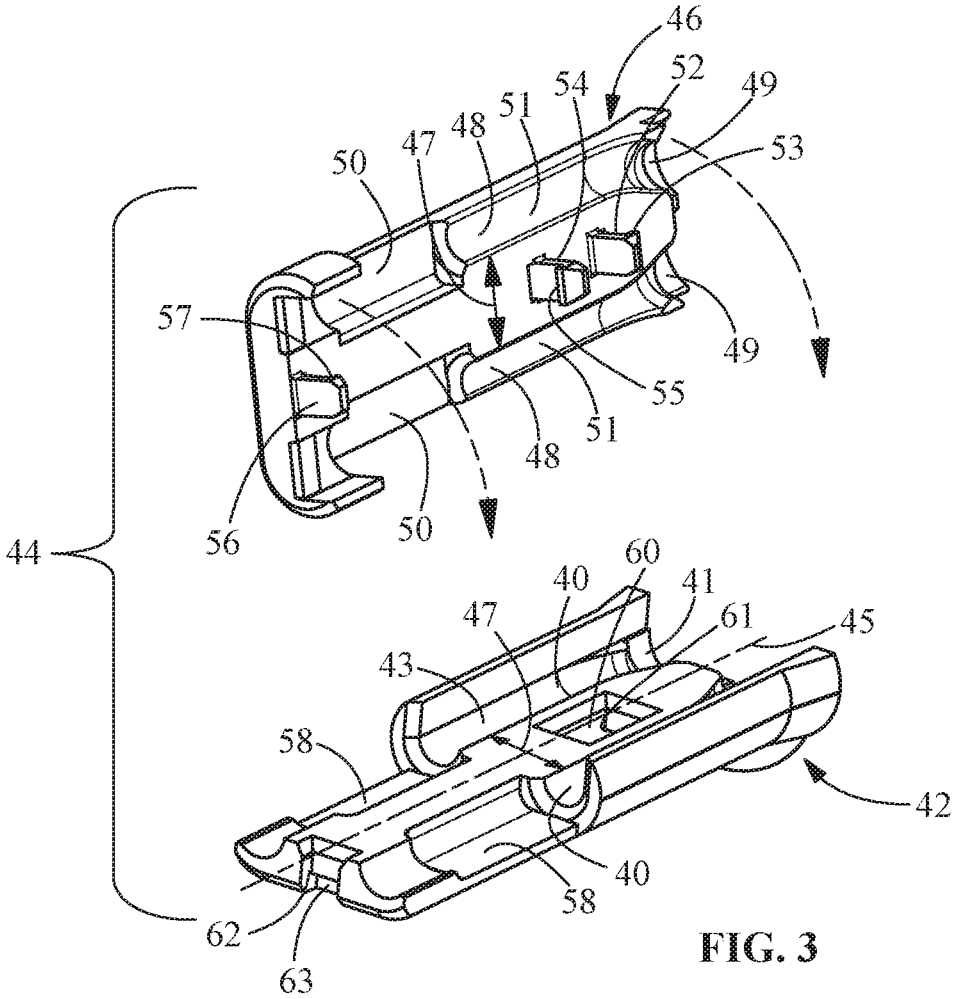
FIG. 3 is an enlarged perspective view of a clamshell connector of the cable assembly.

With the terminals 30 properly terminated to the conductors 18, 20, the exposed portions of the conductors 18, 20 are aligned into a clamshell connector or housing 44. The clamshell connector 44 is made of a dielectric material. As shown in FIG. 3, the clamshell connector 44 has a first or bottom portion 42 and a second or top portion 46.

As shown in FIGS. 3 and 4, the bottom portion 42 has conductor receiving recesses 40 for receiving the conductors 18, 20 therein. The conductor receiving recesses 40 have conductor receiving portions 41 and conductor transition or spacing portions 43. The conductor receiving portions 41 extend at an angle relative to a longitudinal axis 45 of the housing 44 to receive and space apart the conductors 18, 20 as the conductors 18, 20 exit the cable 10. The conductor spacing portions 43 extend in a direction which is essentially parallel to the longitudinal axis 45 of the housing 44. The spacing portions 43 are spaced apart by the distance 47.

The bottom portion 42 has conductor receiving recesses 40 for receiving the conductors 18, 20 therein. The conductor receiving recesses 40 extend to terminal receiving recesses 58 which are dimensioned to receive the wire terminating portions 32 of the terminals 30 therein. A latch receiving opening 60 is positioned between the conductor receiving recesses 40. The latch receiving opening 60 has latching shoulders 61 extending from sidewalls thereof. A latch receiving recess 62 is positioned between the terminal receiving recesses 58. The latch receiving recess 62 has a latching shoulder 63 extending from a sidewall thereof.

The top portion 46 has conductor receiving recesses 48 for receiving the conductors 18, 20 therein. The conductor receiving recesses 48 have conductor receiving portions 49 and conductor transition or spacing portions 51. The conductor receiving portions 49 extend at an angle relative to the longitudinal axis 45 of the housing 44 to receive and space apart the conductors 18, 20 as the exit the cable 10. The conductor spacing portions 51 extend in a direction which is essentially parallel to the longitudinal axis 45 of the housing 44. The spacing portions 51 are spaced apart by the distance 47.

The conductor receiving recesses 48 extend to terminal receiving recesses 50 which are dimensioned to receive the wire terminating portions 32 of the terminals 30 therein. Latches 52, 54 extend from the top portion 46 and are positioned between the conductor receiving recesses 48. The latches 52, 54 have latching shoulders 53, 55. A latch 56 extends from the top portion 46 and is positioned between the terminal receiving recesses 50. The latch 56 has a latching shoulder 57. In the illustrative embodiment shown, the latches 52, 54, and 56 have similar configurations. However, other configurations of the latches may be used.

Figure 5:
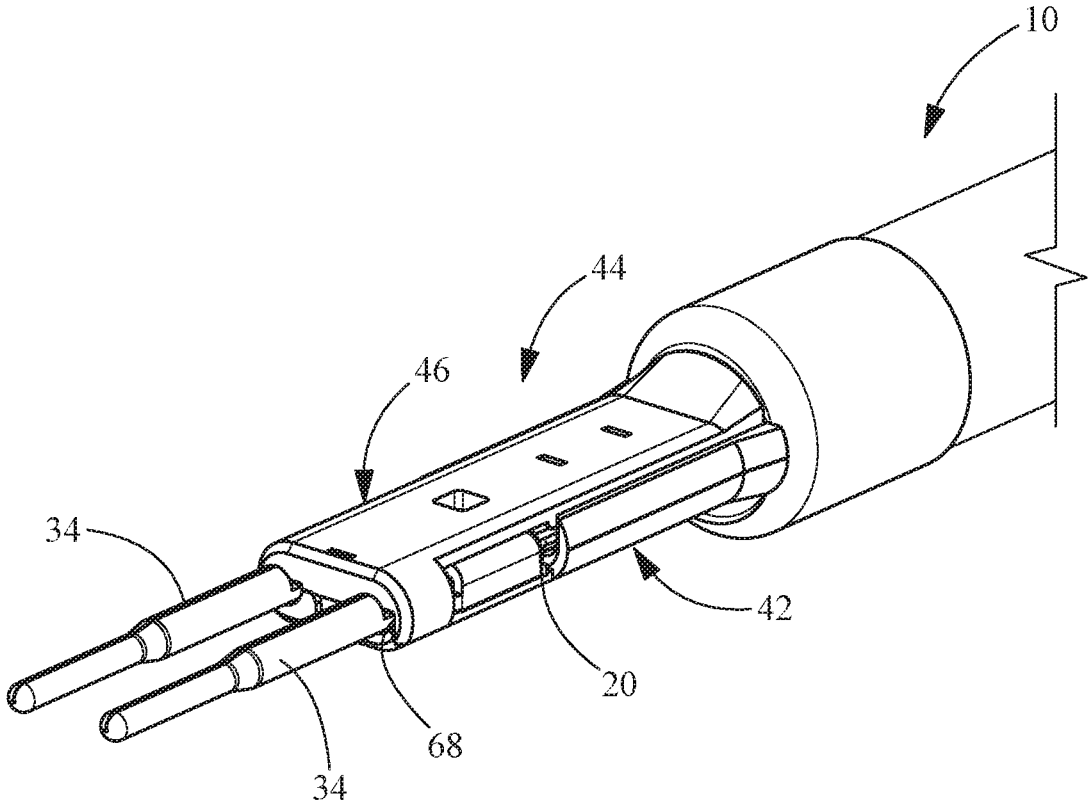
FIG. 5 is an enlarged perspective view of the clamshell connector fully inserted onto the conductors.

As shown in FIG. 5, the bottom portion 42 and top portion 46 are configured to be secured together to enclose the exposed portions of the conductors 18, 20. When secured, the exposed portions of the conductors 18, 20 are positioned in a first and second conductor receiving openings 66 (FIG. 7) formed by the conductor receiving recesses 40, 48. The conductor receiving openings 66 include first and second conductor transition or spacing portions 65 which are formed by the first conductor transition or spacing portions 43 and second conductor transition or spacing portions 51 when the bottom portions 42 is mated to the top portion 46. The conductor receiving openings 66 also include first and second conductor receiving portions 67 which are formed by first conductor receiving portions 41 and second conductor receiving portions 49 when the bottom portions 42 is mated to the top portion 46. The wire terminating portions 32 of the terminals 30 are positioned in first and second terminal receiving openings 68 (FIG. 7) formed by the terminal receiving recesses 50, 58.

The bottom portion 42 and the top portion 46 are retained in the closed position by the cooperation of the latching shoulders 53, 55 of the latches 52, 54 with the latching shoulders 61 of the latch receiving opening 60 and the latching shoulder 57 of the latch 56 with the latching shoulder 63 of the latch receiving recess 62.

The positioning of the exposed portions of the conductors 18, 20 in the first and second conductor receiving portions 67 of the first and second conductor receiving opening 66 of the clamshell connector 44 maintains the proper positioning and desired spacing of exposed portions of the conductors 18, 20 to allow mating to a mating connector. In the illustrative embodiment, the exposed portions of the conductors 18, 20 in the first and second conductor receiving portions 67 extend substantially parallel to each other and in substantially the same plane. As the housing 44 surrounds the exposed portions of the conductors 18, 20, the housing provides protection to the exposed portions of the conductors 18, 20, preventing damage to the exposed portions of the conductors 18, 20, thereby maintaining the integrity of the exposed portions of the conductors 18, 20 and the signal path provided thereby.

As the spacing and dimension of the first and second conductor receiving portions 67 of the first and second conductor receiving openings 66 of the clamshell connector 44 are controlled during the manufacture of the clamshell connector 44, the spacing of the exposed portions of the conductors 18, 20 are also controlled when the conductors are positioned in the first and second conductor receiving portions 67 of the first and second conductor receiving openings 66. Consequently, by properly selecting the dielectric material used for the clamshell connector 44 and properly determining the spacing between the first and second conductor receiving portions 67 formed by the first conductor receiving portions 41 and second conductor receiving portions 49, the impedance of the clamshell connector 44 can be tailored to match or approximately match the impedance of the cable 10.

The positioning of the exposed portions of the conductors 18, 20 in the first and second conductor transition or spacing portions 65 of the first and second conductor receiving opening 66 of the clamshell connector 44 provides a controlled transition with a controlled transition angle 71 between the conductor 18, 20 provided in the cable 10 and the exposed conductors 18, 20 positioned in the first and second conductor receiving portions 67 of the first and second conductor receiving openings 66. The transition angle 71 is the angle as measured between a longitudinal axis 45 of the housing 44 and the surface of the transition portions 65.

As the transition angle 71, spacing and dimension of the first and second conductor receiving openings 66 of the clamshell connector 44 are controlled during the manufacture of the clamshell connector 44, the transition angle 71 and spacing of the exposed portions of the conductors 18, 20 are also controlled when the conductors are positioned in the first and second conductor transition or spacing portions 65 of the first and second conductor receiving openings 66. Consequently, by properly selecting the dielectric material used for the clamshell connector 44 and properly determining the transition angle 71 and spacing between the first and second conductor transition or spacing portions 65 formed by the first conductor transition or spacing portions 43 and second conductor transition or spacing portions 51, the impedance of the clamshell connector 44 can be tailored to match or approximately match the impedance of the cable 10.

With the clamshell connector 44 properly positioned on the exposed portions of the conductors 18, 20 and the wire terminating portions 32 of the terminals 30, a terminal housing 70 (FIG. 7) is provided to provide stability to free ends of contacts 30.

An outer metallic shield member 72 of the cable assembly 74 is secured to the cable 10. As shown in FIGS. 6 and 7, a securing portion 76 of the outer metallic member 72 is positioned over a portion of the cable 10 and the ferrule 26. The securing portion 76 is then secured, for example by crimping, crimped to retain the outer metallic member 72 on the cable 10. A necked down portion 78 of the outer metallic member 72 is positioned over the clamshell connector 44 to provide additional shielding and to maintain the clamshell connector 44 in position. In the embodiment shown, the outer metallic member 72 has two pieces which are mechanically and electrically connected by latches, adhesive, or other know methods of attachment.

The cable assembly 74, and in particular, the clamshell connector 44, provides impedance control and does not damage or rearrange the conductors 18, 20. By properly selecting the dielectric material used for the clamshell connector 44 and properly determining the spacing between the recesses 40, 48, the conductors 18, 20 are properly positioned and the impedance of the clamshell connector 44 can be tailored to match or approximately match the impedance of the cable 10, thereby optimizing the performance of the cable 10 and the cable assembly 74.

One skilled in the art will appreciate that the invention may be used with many modifications of structure, arrangement, proportions, sizes, materials and components and otherwise used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. A connector for controlling impedance for use in a connector assembly, the connector comprising:

a housing having a first conductor receiving opening and a second conductor receiving opening, the first conductor receiving opening and the second conductor receiving opening being dimensioned to receive exposed conductors of a cable;

the first conductor receiving opening and the second conductor receiving opening having conductor receiving portions, the conductor receiving portions extending at a transition angle relative to a longitudinal axis of the housing;

the first conductor receiving opening and the second conductor receiving opening having conductor spacing portions extending from the conductor receiving opening, the conductor spacing portions extending in a direction which is essentially parallel to the longitudinal axis of the housing, the spacing portions are spaced apart by a distance;

the conductor receiving portions configured to control the transition of the exposed conductors from the cable to the conductor spacing portions;

the distance the spacing portions are spaced apart being selected to match the impedance of the cable.

2. The connector for controlling impedance as recited in claim 1, wherein the housing has a first portion and a second portion, the first portion has first conductor receiving recesses and second portion has second conductor receiving recesses which are aligned to form the first and second conductor receiving openings.

3. The connector for controlling impedance as recited in claim 2, wherein the first receiving recesses extend to first terminal receiving recesses and the second conductor receiving recesses extend to second terminal receiving recesses, the first and second terminal receiving recesses are dimensioned to receive wire terminating portions of terminals which are terminated to the ends of the exposed conductors of the cable.

4. The connector for controlling impedance as recited in claim 3, wherein first latches extend from the second portion and are positioned between the second conductor receiving recesses.

5. The connector for controlling impedance as recited in claim 4, wherein a second latch extends from the second portion and is positioned between the second terminal receiving recesses.

6. The connector for controlling impedance as recited in claim 5, wherein the first latches and the second latch have latching shoulders.

7. The connector for controlling impedance as recited in claim 6, wherein the first portion has a latch receiving opening positioned between the first conductor receiving recesses.

8. The connector for controlling impedance as recited in claim 7, wherein a latch receiving recess is positioned between the first terminal receiving recesses.

9. The connector for controlling impedance as recited in claim 8, wherein latch receiving opening and the latch receiving recess have latching shoulders which extend from sidewalls thereof.

10. A cable assembly for terminating a cable having exposed conductors, the cable assembly comprising:

a clamshell connector for controlling impedance for use in a connector assembly, the connector comprising:

a housing made of dielectric material, the housing having a first conductor receiving opening and a second conductor receiving opening, the first conductor receiving opening and the second conductor receiving opening being dimensioned to receive exposed conductors of a cable;

the first conductor receiving opening and the second conductor receiving opening having conductor receiving portions, the conductor receiving and transition portions extending at a transition angle relative to a longitudinal axis of the housing;

the first conductor receiving opening and the second conductor receiving opening having conductor spacing portions extending from the conductor receiving opening, the conductor spacing portions extending in a direction which is essentially parallel to the longitudinal axis of the housing, the spacing portions are spaced apart by a distance;

the conductor receiving portions configured to control the transition of the exposed conductors from the cable to the conductor spacing portions;

the dielectric material and the distance the spacing portions are spaced apart being selected to match the impedance of the cable;

a shield member extending from the cable, the shield member being positioned over the connector.

11. The cable assembly as recited in claim 10, wherein a securing portion of the shield member is positioned over a portion of the cable and a ferrule of the cable.

12. The cable assembly as recited in claim 11, wherein a necked down portion of the shield member is positioned over the clamshell connector to provide additional shielding and to maintain the clamshell connector in position.

13. The cable assembly as recited in claim 12, wherein shield member has two pieces which are mechanically and electrically connected together.

14. The cable assembly as recited in claim 13, wherein the housing has a first portion and a second portion, the first portion has first conductor receiving recesses and second portion has second conductor receiving recesses which are aligned to form the first and second conductor receiving openings.

15. The cable assembly as recited in claim 14, wherein the first receiving recesses extend to first terminal receiving recesses and the second conductor receiving recesses extend to second terminal receiving recesses, the first and second terminal receiving recesses are dimensioned to receive wire terminating portions of terminals which are terminated to the ends of the exposed conductors of the cable.

16. The cable assembly as recited in claim 15, wherein first latches extend from the second portion and are positioned between the second conductor receiving recesses.

17. The cable assembly as recited in claim 16, wherein a second latch extends from the second portion and is positioned between the second terminal receiving recesses.

18. The cable assembly as recited in claim 17, wherein the first latches and the second latch have latching shoulders.

19. The cable assembly as recited in claim 18, wherein the first portion has a latch receiving opening positioned between the first conductor receiving recesses and a latch receiving recess is positioned between the first terminal receiving recesses.

20. The cable assembly as recited in claim 19, wherein latch receiving opening and the latch receiving recess have latching shoulders which extend from sidewalls thereof.

* * * * *